United States Patent [19]

Hinchman et al.

[11] 4,163,632

[45] Aug. 7, 1979

[54] HYDRAULIC PUMP MECHANICALLY INTERCONNECTED WITH FLUID MOTOR DISTRIBUTORS

[75] Inventors: Leslie R. Hinchman; Robert B. Hinchman, Sr., both of San Benito, Tex.

[73] Assignee: Bessie L. Caldwell, San Benito, Tex.; a part interest

[21] Appl. No.: 823,465

[22] Filed: Aug. 10, 1977

[51] Int. Cl.[2] ..... F04B 17/00; F04B 35/00

[52] U.S. Cl. ..... 417/318; 417/397; 417/399; 417/404

[58] Field of Search ..... 417/399, 403, 404, 397, 417/318; 91/341 R; 403/364, 381

[56] References Cited

U.S. PATENT DOCUMENTS

| | | | |
|---|---|---|---|
| 467,274 | 1/1892 | Brown | 417/318 |
| 482,814 | 9/1892 | Smedley | 417/318 |
| 592,633 | 10/1897 | Keith | 417/404 |
| 1,398,695 | 11/1921 | Hull | 403/364 |
| 1,714,425 | 5/1929 | Knab | 417/397 |
| 2,369,365 | 2/1945 | Nichols | 417/399 |
| 2,951,745 | 9/1960 | Sweet et al. | 417/397 |
| 2,986,907 | 6/1961 | Hoop | 417/393 |

FOREIGN PATENT DOCUMENTS

| | | | |
|---|---|---|---|
| 2262768 | 8/1973 | Fed. Rep. of Germany | 137/99 |

*Primary Examiner*—William L. Freeh
*Assistant Examiner*—Thomas I. Ross
*Attorney, Agent, or Firm*—Clarence A. O'Brien; Harvey B. Jacobson

[57] ABSTRACT

A hydraulic pump assembly having a motor actuated by a source of fluid under pressure and in turn actuating a fluid pump under the control of a valve responsive to operation of the motor. The diameter of a piston of the pump is smaller than the corresponding diameter of a piston of the motor in order to permit the pump to obtain higher output pressures than are required to actuate the motor. The valve includes a valve element connected directly to the piston of the motor and slidably disposed in a pair of axially spaced, cylindrical housing parts so as to sequentially place ports provided in spaced ends of the valve element in communication with passages provided in the cylindrical housing parts.

1 Claim, 5 Drawing Figures

HYDRAULIC PUMP MECHANICALLY INTERCONNECTED WITH FLUID MOTOR DISTRIBUTORS

BACKGROUND OF THE INVENTION

1. Field of the Invention

This invention relates generally to hydraulic pumps, and particularly to a hydraulic pump of the kind generally referred to as a pressure intensifier, and which is capable of increasing the pressure of a fluid from an available source.

2. Description of the Prior Art

It is well known to employ boosters to intensify fluid pressures by use of different effective areas of a motor portion and a pump portion of the booster. Examples of such boosters, or intensifiers, can be found in U.S. Pat. Nos. 2,293,076, issued Aug. 18, 1942, to R. Fonting; 2,296,647, issued Sept. 22, 1942, to J. H. McCormick; 2,484,884, issued Oct. 18, 1949, to J. C. Hanna; and 2,508,298, issued May 16, 1950, to O. J. Saari. These devices find frequent use where high pressure intensities are needed and expensive high-pressure pumps are not justified. Thus, a booster or intensifier is employed to increase the pressure of an available fluid source.

It also has been long known to employ double piston and cylinder arrangements in conjunction with an air compressor, and the like, wherein the piston rods are connected to one another, and to a drive shaft, by a rocker arm. Examples of such well known arrangements can be found in U.S. Pat. Nos. 222,802, issued Dec. 23, 1879, to W. P. Tatham, and 2,867,375, issued Jan. 6, 1959, to H. Petersen.

SUMMARY OF THE INVENTION

It is an object of the present invention to provide a hydraulic pump capable of intensifying a fluid under pressure taken from a source which is the same as or different from the source of fluid under pressure which actuates the pump.

It is another object of the present invention to provide a hydraulic pump having an improved control valve construction which can be employed with various arrangements of pump assemblies.

It is still another object of the present invention to provide a fluid booster, or intensifier, which is simple in construction, yet reliable to operate and easy to maintain.

These and other objects are achieved according to the present invention by providing a hydraulic pump having: a motor connected to a source of fluid under pressure for being actuated by the fluid; a valve responsive to movement of the motor controlling operation of the motor; and a pump connected to the motor for actuation thereby and increasing the pressure of a fluid passed through the pump.

The valve preferably includes a hollow housing provided with two sets of cooperating inlet ports and outlet ports. A valve element is slidably disposed within the housing, and is provided with two sets of passages selectively communicating with the associated inlet ports and outlet ports. Attached to the valve element and to the motor of the device is a connector arrangement for reciprocating the valve element within the housing thereof as a function of reciprocal movement of a piston partially forming the motor.

The housing is divided into two separate parts, each of the parts having a set of the passages associated therewith. Each of the parts is mounted in spaced relationship on the motor.

The motor and pump each include a piston and cylinder, with the piston of one of the motor and pump being arranged for reciprocating motion within the associated cylinder thereof, such motion being substantially parallel to motion of the piston of the other of the pump and motor. In one preferred embodiment of the invention, a rocker is pivotally mounted at a pivot point disposed between the motor and pump, with the motor and pump being parallel to and coextensive with one another, and is pivotally connected to the piston of each of the motor and pump. The valve is disposed between the motor and the pivot point of the rocker, and a pin is attached to the rocker so as to engage with the valve element and cause same to reciprocate. In the other preferred embodiment of the invention disclosed herein, the motor and piston each include a reciprocating piston and a cooperating cylinder, with the piston of the pump being attached directly to the piston of the motor coaxially thereof for movement by the motor piston. The cylinder of the pump is disposed in communication with and connected to the cylinder of the motor at a one end of the cylinder of the motor. A pin is connected directly to both the valve element and the piston of the motor in order to achieve the desired coupling.

In the latter mentioned embodiment of the invention, the pump piston, of which there are preferably two disposed at the longitudinal ends of the motor piston, is removably attached to the motor piston by means of a T-slot and T-head arrangement.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
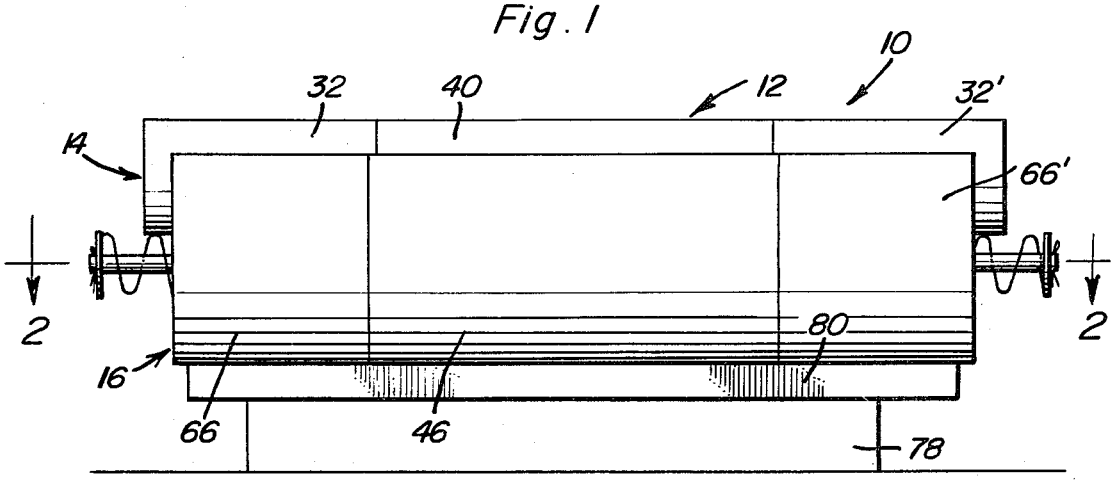
FIG. 1 is a schematic, elevational view showing a first embodiment of a hydraulic pump according to the present invention.
Figure 2:
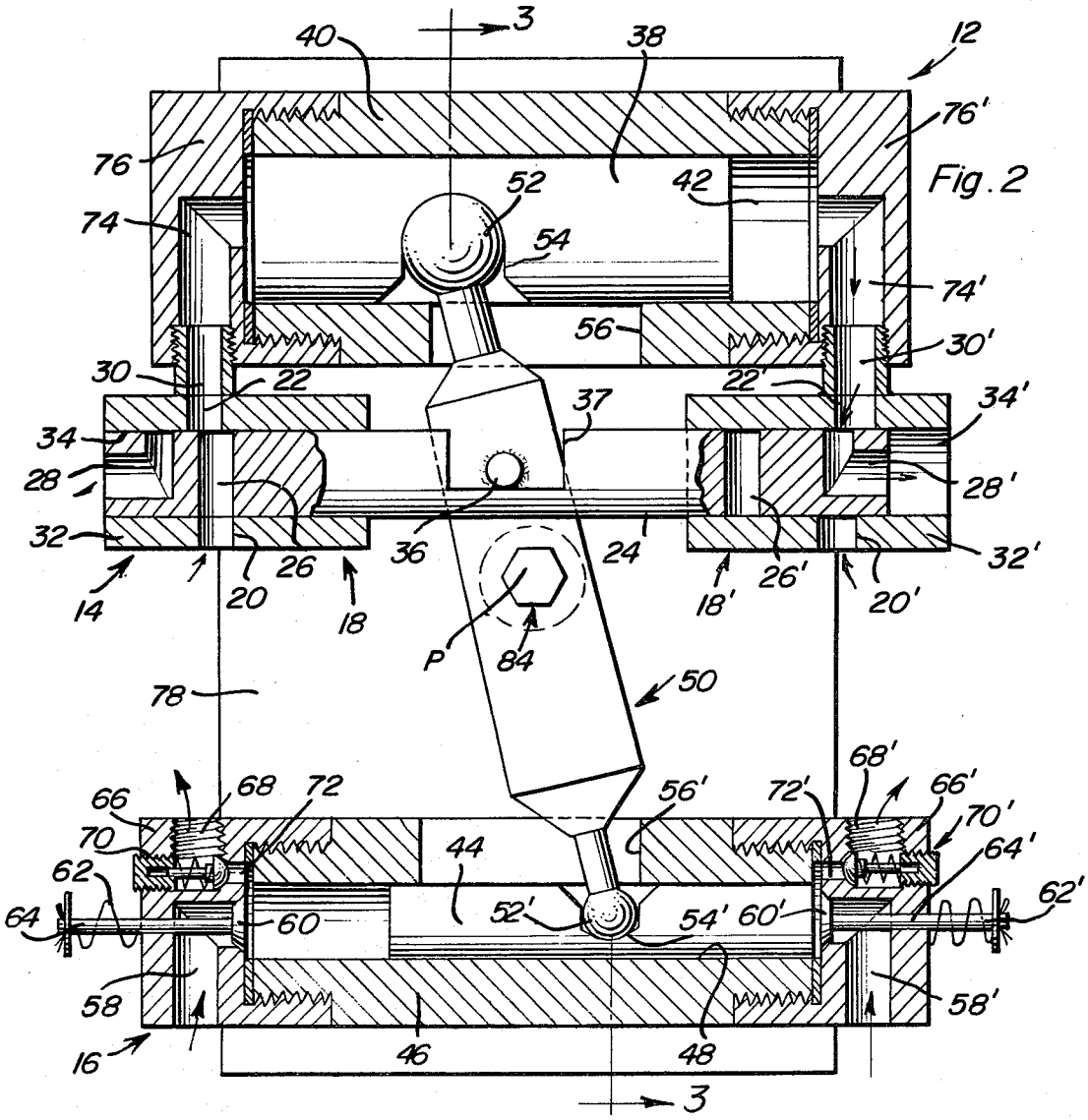
FIG. 2 is a schematic, sectional view taken generally along the line 2—2 of FIG. 1.
Figure 3:
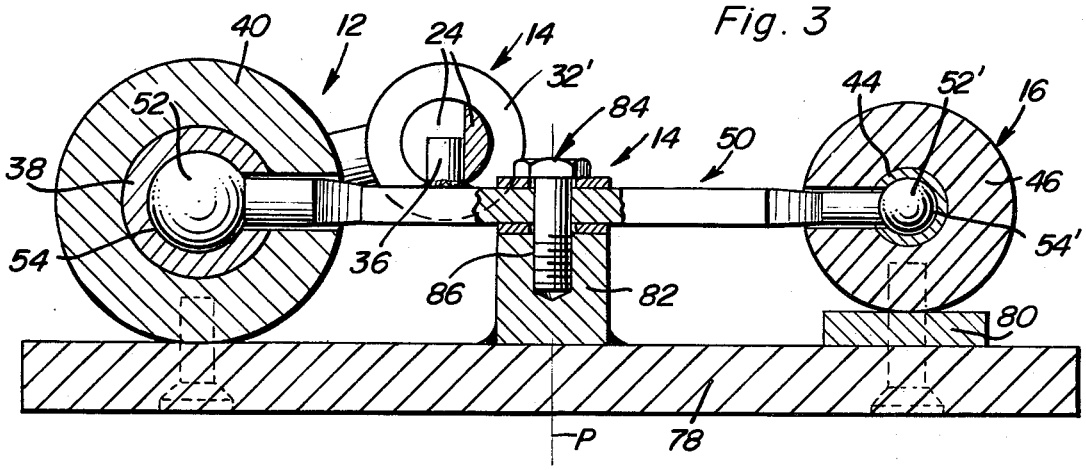
FIG. 3 is a schematic, sectional view taken generally along the line 3—3 of FIG. 2.

Referring now more particularly to FIGS. 1 through 3 of the drawings, a pump assembly 10 according to the present invention comprises a motor 12 connected to a source (not shown) of fluid under pressure for being actuated by the fluid, a valve 14 responsive to motion of the motor 12 for controlling operation of motor 12, and a pump 16 connected to motor 12 for actuation thereby and increasing the pressure of a fluid to a much higher value than the pressure of the fluid used to actuate motor 12. The fluid whose pressure is increased, or intensified, by pump 16 may either be the same fluid as used to actuate motor 12 or, due to the construction of the invention, can be a different fluid, as desired.

Valve 14 includes a hollow housing 18, 18' provided with two sets of cooperating ports 20, 20' and 22, 22' disposed at each end of a longitudinally extending valve element 24. Provided in valve element 24 are passages 26, 26' and 28, 28' arranged for selectively communicating with the ports 20, 20' and 22, 22' so as to permit the working fluid to pass to and from motor 12.

Housing 18, 18' is divided into two separate parts 32 and 32', each in the form of a generally cylindrical sleeve and having a set of the ports 20, 22 and 20', 22'. Further, each of the parts 32, 32' is mounted in axially spaced relation from one another, so as to be associated with a respective longitudinal end of valve element 24, and is connected to motor 12 as by the coupling 30, 30'. Each of the parts 32, 32' is provided with a bore 34, 34' arranged for receiving an associated end portion of valve element 24 in sliding relationship so as to permit element 24 to reciprocate as a function of the motion of motor 12.

A pin 36 engages valve element 24, or more specifically the illustrated peripheral slot 37 provided therein, so as to cause valve element 24 to reciprocate with a slight lost-motion.

Motor 12 includes a piston 38 slidably disposed within a cylinder 40 provided with a through bore 42. In a like manner, pump 16 includes a piston 44 slidably disposed in a cylinder 46 provided with a bore 48. The pistons 38 and 44 are in each instance arranged for reciprocating motion in their associated cylinder bore 42, 48, with the reciprocating path of each of the pistons 38 and 44 being substantially parallel to, and coextensive with, the path of the other of the pistons 44, 38. A rocker 50 is pivotally mounted for swinging movement about the axis P, and each arm of rocker 50 engages a respective one of the pistons 38 and 44 as by the illustrated balls 52, 52' received in corresponding sockets 54, 54'. The slots 56 and 56' provided in the peripheral walls of the cylinders 40 and 46, respectively, permit rocker 50 to swing with the reciprocating movement of piston 38. The housing 18, 18' of valve 14 can be seen as being disposed between the motor 12 and pivot point P of rocker 50, with pin 36 being affixed to the adjacent arm of rocker 50 so as to engage in the slot 37 provided in valve element 24 and cause valve element 24 to reciprocate as a function of reciprocating motion of piston 38.

Pump 16 includes intake openings 58, 58' in which is disposed for selectively blocking same a respective valve element 60, 60' biased toward a closed position as by a coiled compression spring 62, 62' arranged with the coils thereof surrounding a stem 64, 64' of the respective valve elements 60, 60' and arranged extending outwardly from an associated head 66, 66' of the pump 16. Also provided in each of the heads 66, 66' which are removably attached, as by the illustrated screw threads, to the longitudinally spaced ends of cylinder 46 of pump 16, are discharge openings 68, 68', each of which has disposed therein a respective valve 70, 70' so as to selectively block fluid flow through a flow path 72, 72' communicating with bore 48 provided in the cylinder 46 of pump 16.

The basic construction of the housing of motor 12 is similar to that of pump 16, and includes flow paths 74, 74' provided in heads 76, 76' removably attached, as by the illustrated screw threads, on either longitudinal end of cylinder 40 of motor 12. These flow paths 74, 74' place bore 42 of cylinder 40 in communication with the couplers 30 and 30' which connect the parts 32, 32' of valve housing 18, 18' to the respective heads 76, 76' of motor 12.

Motor 12 and pump 16 are mounted on a substantially planar base plate 78, with pump 16 being raised slightly from the upper surface of plate 78 by a mounting plate 80. Conventional screws, and the like, can be employed for removably mounting the motor 12 and pump 16 onto plate 78. Further, a post 82 is affixed to the upper surface of plate 78 and extends upwardly therefrom for pivotally mounting rocker 50 as by the illustrated screw 84 received in a threaded recess 86 provided in the upper portion of post 82.

In operation, a suitable fluid under pressure is directed into the port 20, 20', and will be passed through the associated coupling 30, 30' into the flow path 74, 74' to exert a force on an associated end of the piston 38 whenever the passage 26, 26' is registered with port 20, 20' and coupling 30, 30'. When a passage 26, 26' is not registered with an associated port 20, 20', the passage 28, 28' is in registration with the associated coupling 30, 30' so as to permit the working fluid to be expelled from the associated end of bore 42. Thus reciprocated, piston 38 will cause rocking movement of rocker 50 about pivot P, with pin 36 causing reciprocating movement of valve element 24 so as to cause the passages 26, 26' and 28, 28' to register with ports 22, 22' in such a manner asto control the flow of operating fluid into and out of bore 42. Further, rocker 50 will cause piston 44 of pump 16 to reciprocate and, thus, cause an operating fluid drawn into the end portions of bore 48 of cylinder 46 through the intake openings 58, 58'. Whenever piston 44 is moved away from an associated one of the valve elements 60, 60', that particular element 60, 60' will be forced open against the bias of the associated spring 62, 62' so as to permit the fluid whose pressure is to be boosted or intensified, to pass into bore 48. Conversely, whenever piston 44 is moving toward a respective one of the flow path 72, 72', the valve 70, 70' associated with that flow path 72, 72' will be forced open, permitting the high pressure fluid to be forced out of pump 16 through the discharge opening 68, 68'.

Figure 4:
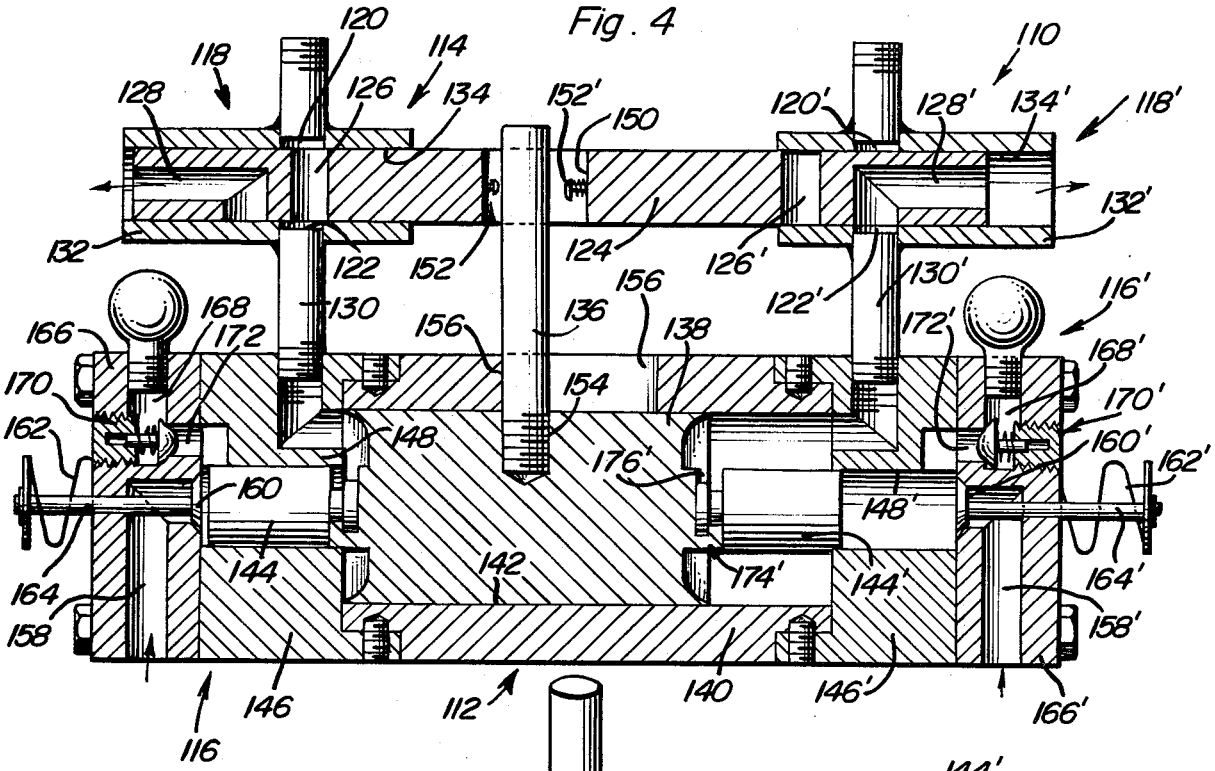
FIG. 4 is a schematic, longitudinal sectional view taken through a second embodiment of a hydraulic pump according to the present invention.
Figure 5:
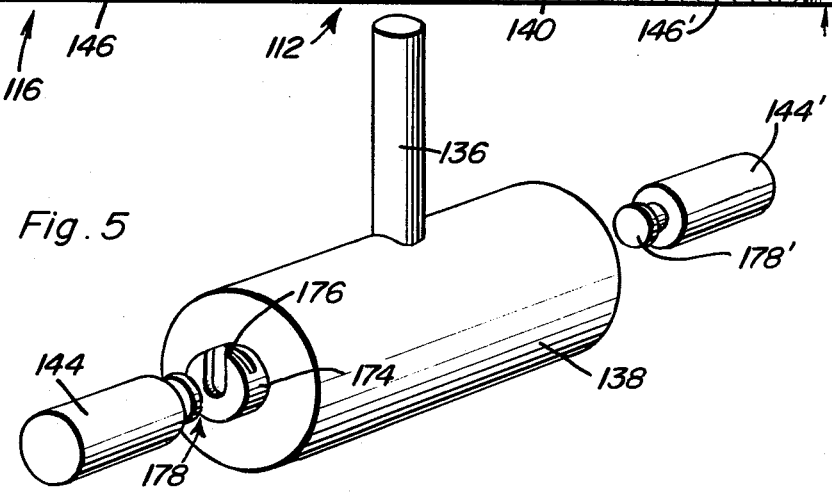
FIG. 5 is a schematic, exploded perspective view showing the manner of attachment of the pump pistons and motor piston to one another to form a single operating unit in accordance with the second embodiment of the invention as seen in FIG. 4.

Referring now more particularly to the embodiment of the invention shown in FIGS. 4 and 5 of the drawings, a pump assembly 110 comprises a motor 112, a valve 114, and a pump 116, 116'.

Valve 114 includes a housing 118, 118' including, in the manner of pump 16, two sets of ports 120, 120' and 122, 122', and a valve element 124 which extends longitudinally and has in the longitudinal end portions thereof passages 126, 126' and 128, 128'. Pipes 130 and 130' connect the ports 122, 122' to a motor to be described below, and also mount the parts 132 and 132' forming housing 118, 118' onto the motor 112. Bores 134 and 134' provided in parts 132 nd 132' slidingly receive the end portions of valve element 124 in a manner similar to that where parts 32, 32' receive the end portions of valve element 24. More particularly, it can be seen from FIG. 4 that the valve 114 is basically the same as valve 14, except for the manner of attachment of a pin 136 to valve element 124.

Motor 112 includes a piston 138 slidably disposed within a cylinder 140 provided with a bore 142 arranged for receiving piston 138. Attached to either end wall of the generally cylindrical piston 138 is a pump piston 144, 144' such that the pistons 144, 144' are disposed coaxially of piston 138 and are slidably disposed themselves in respective cylinders 146 and 146'. Each of the latter mentioned cylinders 146, 146' is provided with a bore 148, 148' which slidably receives the associated piston 144, 144'.

Provided in element 124 is a window 150, similar to slot 37 provided in element 24, which forms opposed cam surfaces for selective engagement by pin 136 in order to reciprocate the element 124. Provided on the cam surfaces can be the illustrated shifting boosters 152, 152', which can be in the form of spring-biased plungers, arranged for imparting an extra force to element 124 as same is being shifted in the direction where cam surfaces associated with a respective one of the boosters 152, 152' is moving away from pin 136. The latter is attached to motor piston 138 by threading engagement in a screw threaded hole 154 provided in a peripheral portion of the cylindrical surface of piston 138, and pin 136 is disposed in a slot 156 provided in the peripheral portion of cylinder 140 of motor 112 so as to permit pin 136 to reciprocate back and forth with the piston 138.

In a like manner to the valving of pump 16, pump 116, 116' has intake openings 158, 158' in which are disposed valve elements 160, 160' biased toward a closed position by springs 162, 162' arranged with coils disposed around the associated stem 164, 164' of the valve element 160, 160' so that the springs 162, 162', and the associated stem 164, 164' extend away from respective heads 166, 166'. Suitable openings are provided in the heads 166, 166' to permit sliding passage therethrough of the stems 164, 164'. Discharge openings 168, 168' have disposed therein pressure-actuated valves 170, 170' which normally block associated flow path 172, 172'. The operation of this valving is the same as for pump assembly 10 as described above.

Each of the pump pistons 144, 144' is connected to the motor piston 138 by provision on the substantially parallel, spaced, end walls of piston 138 of disk-like extensions 174 and 174' each provided with a T-slot 176 and 176'. T-heads 178 and 178' sized to mate with the T-slots 176, 176', are provided on one of the ends of the cylindrical pistons 144, 144' so that the T-heads 178 and 178' can be slidably received in the T-slots 176, 176' and thereby hold the pistons 144, 144' on the motor piston 138 in a rugged manner, yet such that the pistons 144, 144' can be readily removed for maintenance and other purposes.

It will be seen that the operation of pump assembly 110 is essentially identical to that of pump assembly 10, inasmuch as the reciprocating movement of piston 138 causes, with a slight lost-motion, reciprocating movement of valve element 124 so as to bring the appropriate ports 120, 120' and 122, 122' into registration with the passages 126, 126' and 128, 128' to actuate motor 112. It will be further appreciated that since one of the passages 126, 126' will always be in registration with the ports 120, 122 or 122', 122', motor 12 can be self-started by controlling the fluid pressure thereon in a conventional manner, not shown.

As can be readily understood from the above description and from the drawings, a hydraulic pump assembly according to the present invention provides a pressure booster, or intensifier, of simple yet rugged and reliable construction that can be used for many applications where high pressure output is required with only a low pressure source available.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A hydraulic pump assembly, comprising, in combination:

(a) motor means connected to a source of fluid under pressure for being actuated by the fluid;

(b) valve means connected to the motor means for controlling operation of the motor means; and (c) pump means connected to the motor means for actuation thereby and for increasing the pressure of a fluid passed through the pump means, the valve means inluding, in combination:

(1) a hollow housing provided with two sets of cooperating ports;

(2) a valve element slidably disposed within the housing and provided with two sets of passages selectively communicating with the associated ports for controlling fluid flow to and from the motor means; and (3) coupler means attached to the valve element and to the motor means for reciprocating the valve element within the housing of the valve means, the housing being divided into two separate, spaced parts, each of the parts having a set of the ports associated therewith, and each of the parts being mounted in spaced relation with respect to one another on the motor means, the valve element extending longitudinally, and the coupling means including a pin engaging the valve element substantially midway of the longitudinal extend of the valve element, an opening being provided in the valve element for receiving the pin in a lost-motion relationship, the motor means and pump means each including an elongated piston and cylinder, with the piston of one of the motor means and pump means being arranged for reciprocating motion within the associated cylinder thereof substantially parallel to the piston of the other of the pump means and motor means and within the associated cylinder thereof, and in spaced relationship with respect thereto, and a rocker pivotally mounted at a pivot point disposed between the motor means and the pump means and pivotally connected directly to the piston intermediate the elongation of each, the valve means being disposed between the motor means and the pivot point of the rocker, and the pin being affixed to the rocker between the motor means and the pivot point of the rocker for engaging the valve element of the valve means.

* * * * *